US012240577B2

(12) United States Patent
Cooper et al.

(10) Patent No.: US 12,240,577 B2
(45) Date of Patent: Mar. 4, 2025

(54) PEDAL DRIVE AND STEERING ASSEMBLY FOR INFLATABLE WATERCRAFT AND WATERCRAFT COMBINED WITH SAME

(71) Applicant: BOTE, LLC, Miramar Beach, FL (US)

(72) Inventors: Corey Cooper, Destin, FL (US); Aaron May, Parker, CO (US)

(73) Assignee: Bote, LLC, Miramar Beach, FL (US)

( * ) Notice: Subject to any disclaimer, the term of this patent is extended or adjusted under 35 U.S.C. 154(b) by 0 days.

(21) Appl. No.: 18/524,209

(22) Filed: Nov. 30, 2023

(65) Prior Publication Data

US 2024/0092467 A1 Mar. 21, 2024

Related U.S. Application Data

(63) Continuation of application No. 17/235,838, filed on Apr. 20, 2021, now abandoned.

(51) Int. Cl.

| | |
|---|---|
| ***B63H 16/20*** | (2006.01) |
| ***B63B 3/40*** | (2006.01) |
| ***B63B 3/48*** | (2006.01) |
| ***B63B 7/08*** | (2020.01) |
| ***B63B 34/10*** | (2020.01) |
| ***B63B 34/22*** | (2020.01) |
| ***B63H 23/34*** | (2006.01) |
| ***B63H 25/10*** | (2006.01) |
| ***B63H 25/38*** | (2006.01) |

(52) U.S. Cl.

CPC ..... *B63H 16/20* (2013.01); *B63B 3/40* (2013.01); *B63B 3/48* (2013.01); *B63B 7/087* (2013.01); *B63H 23/34* (2013.01); *B63H 25/10* (2013.01); *B63H 25/38* (2013.01); *B63B 34/10* (2020.02); *B63B 34/22* (2020.02); *B63H 2016/202* (2013.01)

(58) Field of Classification Search

CPC ..... B63H 16/00; B63H 16/08; B63H 16/12; B63H 16/20; B63H 2016/202; B63H 23/34; B63H 25/10; B63H 25/38; B63B 3/40; B63B 3/48; B63B 7/087; B63B 34/10; B63B 34/22

USPC ..... 440/21, 26, 27, 29

See application file for complete search history.

(56) References Cited

U.S. PATENT DOCUMENTS

| | | | | |
|---|---|---|---|---|
| 6,022,249 | A * | 2/2000 | Ketterman | B63H 16/12 440/13 |
| 6,869,323 | B2 * | 3/2005 | Norman | B63H 16/14 440/28 |
| 7,264,521 | B2 * | 9/2007 | Gardner | B63H 16/12 441/27 |
| 11,034,423 | B2 * | 6/2021 | Pelland | B63H 16/20 |
| 11,148,775 | B2 * | 10/2021 | Kuehmichel | B60L 50/20 |
| 11,518,481 | B2 * | 12/2022 | Steed | B63B 5/24 |
| 2016/0075420 | A1 | 3/2016 | Kiffmeyer | |

OTHER PUBLICATIONS

Extended search report in EP 22169116.5 dated Jan. 20, 2023.

* cited by examiner

*Primary Examiner* — Daniel V Venne
(74) *Attorney, Agent, or Firm* — BakerHostetler

(57) ABSTRACT

A pedal assembly and steering assembly are disclosed for converting an inflatable, drop stitch paddle watercraft into a pedal watercraft. The pedal assembly includes a mounting plate and mounting bracket for supporting a geared drive shaft in an opening extending through the floor of the watercraft. The steering assembly includes a rudder connected to a tiller through push pull cables.

7 Claims, 14 Drawing Sheets

PEDAL DRIVE AND STEERING ASSEMBLY FOR INFLATABLE WATERCRAFT AND WATERCRAFT COMBINED WITH SAME

This patent application is a continuation of U.S. patent application Ser. No. 17/235,838, filed Apr. 20, 2021 and entitled "Pedal Drive and Steering Assembly for Inflatable Watercraft and Watercraft Combined with Same."

BACKGROUND OF THE INVENTION

1. Field of the Invention

The present invention relates generally to aquatic sports and recreation, and more specifically to a pedal drive for inflatable watercraft such as kayaks, and a steering assembly that can be fitted on the stern and includes a rudder controlled by a hand operated lever connected to the rudder by push-pull cables. The watercraft is made of inflatable drop stitch material which, when inflated, adopts the physical characteristics of a solid body. The invention contemplates using drop stitch construction to make inflatable panels configured to form the watercraft. A featured aspect of the watercraft is that a preformed hole is provided in the bottom of the watercraft, and the pedal drive passes through the opening and is fixedly mounted in the hole. Because drop stitch fabric allows for the creation of panels having the strength and rigidity of solid wood or fiberglass panels, the pedal drive can withstand forces generated by a person who pedals at a desired speed. Steering is accomplished by a rudder which moves in response to movement of a hand-operated lever connected to the rudder by push-pull cables.

2. Description of the Related Art

Watercraft come in many sizes and varieties. For the active and athletic sports enthusiast, watercraft can combine sports, recreation and physical exercise. Stand up paddle-boards, or SUPs, are popular for the benefit of providing an upper body, back and stomach muscle work out while engaging in simple locomotion, fishing, photography, or any number of other ventures. Kayaks are similarly disposed to provide an upper body workout, but from a sitting position, similar as well to canoeing.

Traditional watercraft such as surf boards, SUPs, kayaks and canoes are known to be made of solid materials, such as wood, plastic, and light metals such as aluminum. In my prior co-pending applications and issued patents, I have described new and novel ways to make kayaks and SUPs from drop stitch inflatable material. These materials are inflated to pressures much greater than other inflatable materials. Because of yarns that extend between and are connected to opposed inner surfaces of inflatable panels, the panels maintain a board-like quality in terms of both shape and strength. While a SUP may be made of a single inflatable panel, other watercraft such as boats and kayaks require separate panels for the bottom, sides and if desired, the deck A great advantage to watercraft made of inflatable drop stitch material is that they are light-weight and easily stowed, carried and deployed on site by inflation. Solid SUPs are carried on roof racks or in truck beds, but in any case, they are relatively difficult to transport. An obvious disadvantage is that a solid SUP cannot be carried on an airplane without making special accommodations for shipping. On the other hand, an inflatable drop stitch SUP can be carried as normal luggage, or as carry-on luggage, due to small space required when the SUP is deflated and folded into a compact space.

Kayaks are generally small, narrow watercraft which are typically propelled by means of a double-bladed paddle. A typical kayak has a covered deck and one or more cockpits, each seating one paddler. The cockpit can be covered by a spray deck that prevents the entry of water from waves or spray, differentiating the craft from a canoe. Neither a kayak nor a canoe is stable when a user stands up inside or on top of either watercraft.

A popular type of kayak for the recreationalist is made of molded, hard plastic, typically in two pieced bonded together and sporting an open deck. Hard, foldable chairs can be mounted on the deck, along with accessories for holding bate, caught fish, beverages, fishing poles and tackle. Commonly, this type of kayak is paddled with a single or double ended paddle.

U.S. Pat. No. 6,022,249, issuing to Ketterman and entitled "Watercraft," describes a molded, solid plastic kayak having a pedal drive and steering rudder. The pedal drive includes a pair of flappers and are actuated by the user alternatively pushing a pair of pedals. The drive flappers extend below the waterline, extending through the hull of the kayak.

With pedal drives such as in Ketterman, permanent "compartments' must be molded into the shape of the bottom of the hull to provide solid, rigid surfaces to which the pedal drive must be connected. Such hulls are made of rotomolding plastic polyethylene, thus creating a watercraft that is relatively heavy, bulky and difficult to transport. Moreover, the push action of the pedal drive, which requires a more or less kicking motion by the user, does not provide the same muscle work out as a preferred, rotating cycling motion as in the rotating pedals of a bicycle.

A need exists for a watercraft and pedal drive combination that combines simplicity of design, light weight and easier storage and transport.

SUMMARY OF THE INVENTION

In one aspect of the invention a drive assembly for an inflatable watercraft includes a pedal drive means for rotating a propeller, and coupling means for detachably coupling the pedal drive means to the inflatable watercraft.

Preferably, the pedal drive means includes a drive shaft having first and second opposite axial ends, first and second pedals mounted on respective first and second pedal support arms, the first and second pedal support arms being rotatably and coaxially connected to the first axial end of the drive shaft, and a propeller rotatably mounted on the second opposite end, and connected through the drive shaft to the first and second pedals, wherein rotation of the pedals imparts rotation of the propeller.

A gearing mechanism is provided in the pedal drive means so that a single rotation of the pedals creates a multiple of rotations of the propeller. A particularly preferred gear ratio is 10:1, although other gear ratios can be used. Variable gear ratios can be provided, although a fixed ratio is preferred for mechanical simplicity and reliability.

In order to couple the drive assembly to a watercraft, the coupling means includes a mounting plate fixedly connected to a medial portion of the drive shaft and extends substantially normal to the drive shaft. The mounting plate preferably includes a window that allows the user to see beneath the boat. The mounting plate is dimensioned and sized to cover and seal the hole in the bottom of the watercraft.

A mounting arm is preferably pivotally connected to the drive assembly at the upper distal end where the pedals are mounted. The opposite end of the mounting arm has a removable pin which is used to rotatably connect the mounting arm to the floor of the watercraft forward of the mounting hole. When so connected, the entire drive assembly can be rotated and translated to move between positions of storage on the floor of the watercraft in a substantially horizontal orientation, and of activation vertically extending through the hole in the watercraft. A handle can be provided, extending between the drive shaft and the mounting plate as a convenient way to pick up and manipulate the drive assembly into and out of an active position.

Preferably, the coupling means includes a base having a horizontally oriented that circumscribes an opening provided in the watercraft, a collar that extends at least partially into the opening, and a base coupling means for detachably coupling the base to the watercraft. The base is made of a single piece of molded plastic and is sized to fit snugly into the opening with the flange being substantially coplanar with a floor of the watercraft. The base coupling means includes complimentary fasteners such as first nylon straps adhesively bonded to the watercraft around the opening and second nylon straps adhesively bonded to the collar. A connection between complimentary straps can be made by a snap fitted "G" clamp or other suitable clamps which are designed with quick connect/disconnect features.

An opening or "pedal port," preferably preformed in the floor panel of a drop stitch constructed watercraft, such as a kayak, has a length terminated in rounded or circular ends. As with all drop stitch watercraft of my design, the floor panel of the kayak is on the order of a few inches thick, and comprised of upper and lower sheets of plastic material, preferably reinforced, and held together internally by multiple strands or yarns that are bonded to opposing internal surfaces of the respective sheets. Such panels can be inflated to pressures between 4 and 20 p.s.i., which would ordinarily deform and destroy inflatable structures that do not employ drop stitch material.

In a preferred embodiment of the present invention, the detachable coupling means further includes a plurality of dogs located around the periphery of the flange, and a receptacle formed at the forward end of the flange. When the mounting plate is fitted over the mounting plate, with the drive shaft extending through the opening, the dogs are rotated to engage a peripheral portion of the mounting plate, and thereby hold the mounting plate tightly to the flange.

When the pedal drive assembly is not being used, whether stowed on the watercraft or missing entirely, a clear window having the same shape as the opening is fitted over the opening and held tightly in place by rotating the dogs. The window preferably includes a foot formed on the forward end that fits into the receptacle formed on the flange. The receptacle and dogs provide a strong yet quick connect and disconnect to allow speedy deployment of the pedal drive assembly.

Preferably, the support arm is rotatably connected to the upper end of the drive shaft, and detachably rotatably connectable to the watercraft through a mounting bracket fixedly connected to the floor of the watercraft. The mounting bracket includes a pair of parallel, upstanding support arms that have aligned bores between which the lower end of the mounting arm is fitted. The mounting arm preferably has a bore that is aligned with the bores of the two parallel arms, and a mounting pin extends through the bores, thereby pivotally connecting the mounting arm to the watercraft. When the pedal assembly is mounted in the opening, through the mounting plate, the mounting arm cannot rotate, but provides a brace against peddling forces generated by the user.

Another aspect of the present invention is to provide a steering assembly for an inflatable watercraft, such as a kayak, which includes a rudder adapted to be mounted on a stern of the watercraft, a tiller adapted to be mounted near a sitting position of a user, and cable means connecting the tiller to the rudder, and being operable to impart movement of the tiller to movement of the rudder.

Preferably, the steering assembly includes a detachable mounting means for mounting the rudder to the watercraft. The mounting means can include a mounting plate that attaches to a corresponding plate permanently affixed to the stern of the watercraft. The mounting plate includes pivot pins that allow the rudder to pivot to starboard and port, and upward out of the water.

Preferably, the mounting means includes a first plate that is permanently bonded to the upper surface of the bottom panel that forms the watercraft, near the stern end of the watercraft. A second plate is detachably connected to the first, fixed plate, and is connected thereto by any suitable fastener means such as screws, bolts, pins and other suitable means. The second plate carries first and second rotation pins for allowing the rudder to move port to starboard, and up and down.

Another aspect of the invention is to provide an inflatable watercraft having a bottom panel made of inflatable drop stitch material and having a pedal port formed approximately midship through the bottom panel, a starboard side panel made of inflatable drop stitch material and extending substantially vertically upwardly from the starboard side of the bottom panel, a port side panel made of inflatable drop stitch material and extending substantially vertically upwardly from the port side of the bottom panel, the bottom, starboard and port side panels forming a floor, a bow and a stern, a pedal drive assembly detachably connected to the floor of the watercraft, a steering assembly detachably connected to the stern of the watercraft.

Each panel is inflatable to high pressures between 4 and 20 p.s.i, and when inflated the panels adapt the physical characteristics of solid structures made of wood, fiberglass or plastic. In deflated form, the panels can be rolled or folded into a relatively small space for easy storage and stowage.

Other aspects of the invention will become apparent in view of the following detailed description and claims.

DETAILED DESCRIPTION OF THE INVENTION

Figure 1:
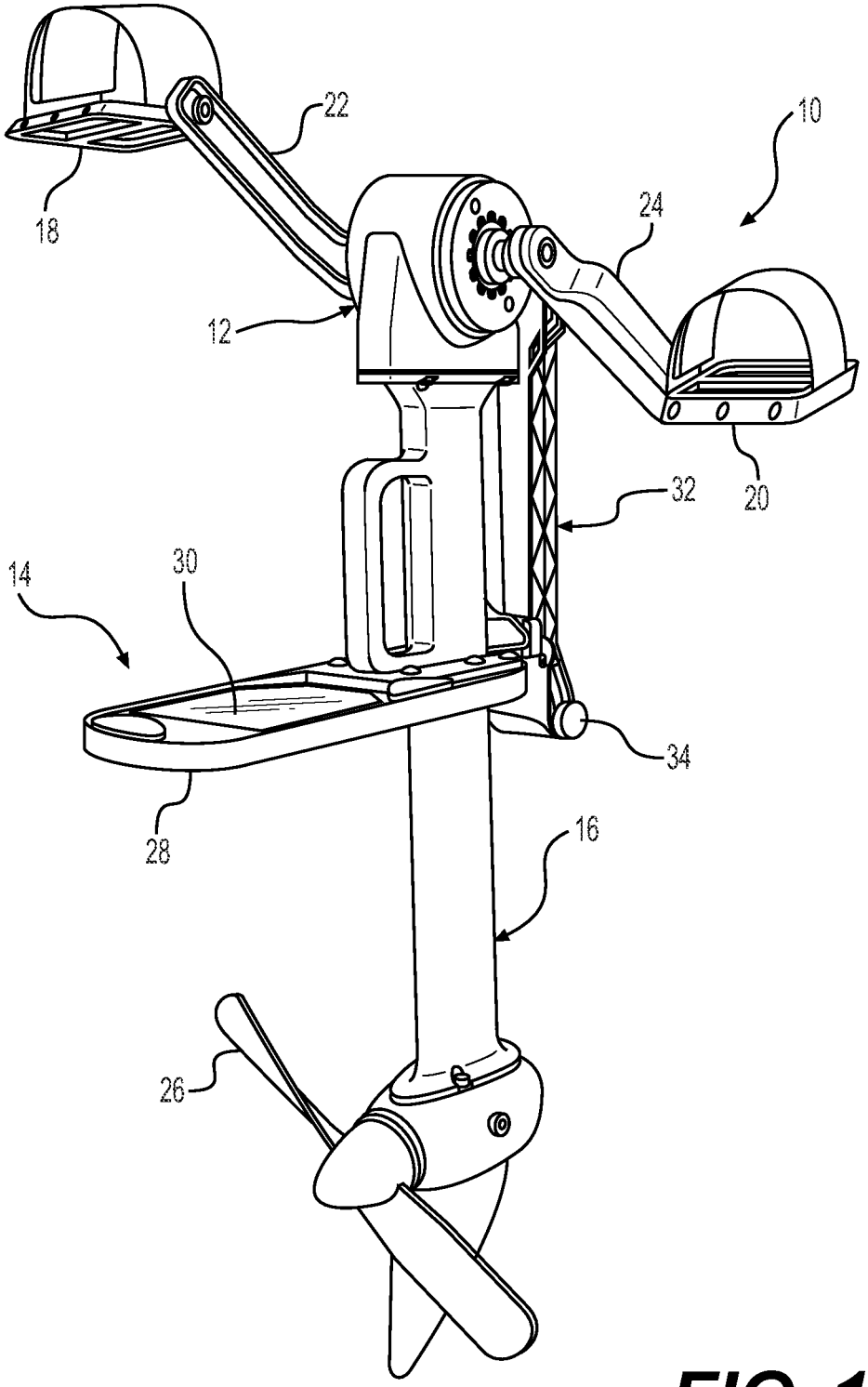
FIG. 1 is a side perspective view of a drive assembly for an inflatable watercraft according to one aspect of the present invention.

Referring to FIG. 1, a drive assembly 10 for an inflatable watercraft includes pedal drive means 12 for rotating a propeller, and coupling means 14 for detachably coupling the pedal drive means 12 to an inflatable watercraft.

Preferably, the pedal drive means 12 includes a drive shaft 16 having first and second opposite axial ends. A first pedal 18 and second pedal 20 are rotatably mounted on respective first support arm 22 and second support arm 24. The first and second pedal support arms 22 and 24 are rotatably and coaxially connected to the first axial end of the drive shaft 16 on a common axle extending through the drive shaft 16 and the first axial, or upper end. A propeller 26 is rotatably mounted on the second opposite end of the drive shaft 16, and is connected through the drive shaft 16 to the first and second pedals 18 and 20, so that rotation of the pedals 18 and 20 imparts rotation of the propeller 26.

The drive shaft 16 includes gearing (not seen) in the upper distal end of the drive shaft 16 to create a geared response, whereby for every rotation of the pedals, the propeller makes a multiple of rotations. A preferred gear ratio is 10:1, although other gear ratios can be used. The preferred ratio is selected as proper balance between work and load, generating a speed that can be varied by the peddler's effort and desired speed.

The coupling means 14 includes a mounting plate 28 fixedly connected to, and preferably integrally formed with, a medial portion of the drive shaft 16. Although illustrated as the draft shaft 16, what is seen in FIG. 1 is the outer casing which encloses a rotatable drive shaft that extends between gearing in the upper distal end and a rotatable shaft on which the propeller 26 is mounted. The gearing, shafts and bearings, as well as grease fittings, packings and seals are conventional and do not need separate illustration.

The mounting plate 28 includes a clear window 30 that can be made of a clear plastic material or other suitable transparent material. When the drive assembly is mounted on the inflatable watercraft, the window 30 provides the user with visible access to what is under the watercraft.

A mounting arm 32 has two opposite axial ends, one of which is pivotally connected to the drive shaft 16 near the pedal support arms 22 and 24. The opposite end has a pin 34 which is removed at first, and the reinstalled after the cylindrical bore through the end of the mounting arm is aligned with a mount fixed to the upper surface of the floor of the watercraft. When the pin is reinstalled, the drive assembly can be laid flat on the bottom of the watercraft, or rotated from the horizontal position on the floor to a vertical position where it is mounted in the mounting hole. A handle 36 extends between the drive shaft 16 and the mounting plate 28 to provide both easy lifting of the drive assembly 10, and strengthening of the mounting plate 28. In use, the forces applied to the pedals 18 and 20 tend to create bending or flexing moments on the drive shaft 16. These forces are resisted by the connection of the mounting plate 28 to the watercraft, the connection of the handle 36 to the mounting plate 28, and the connection of the mounting arm 32 to the watercraft.

Figure 2:
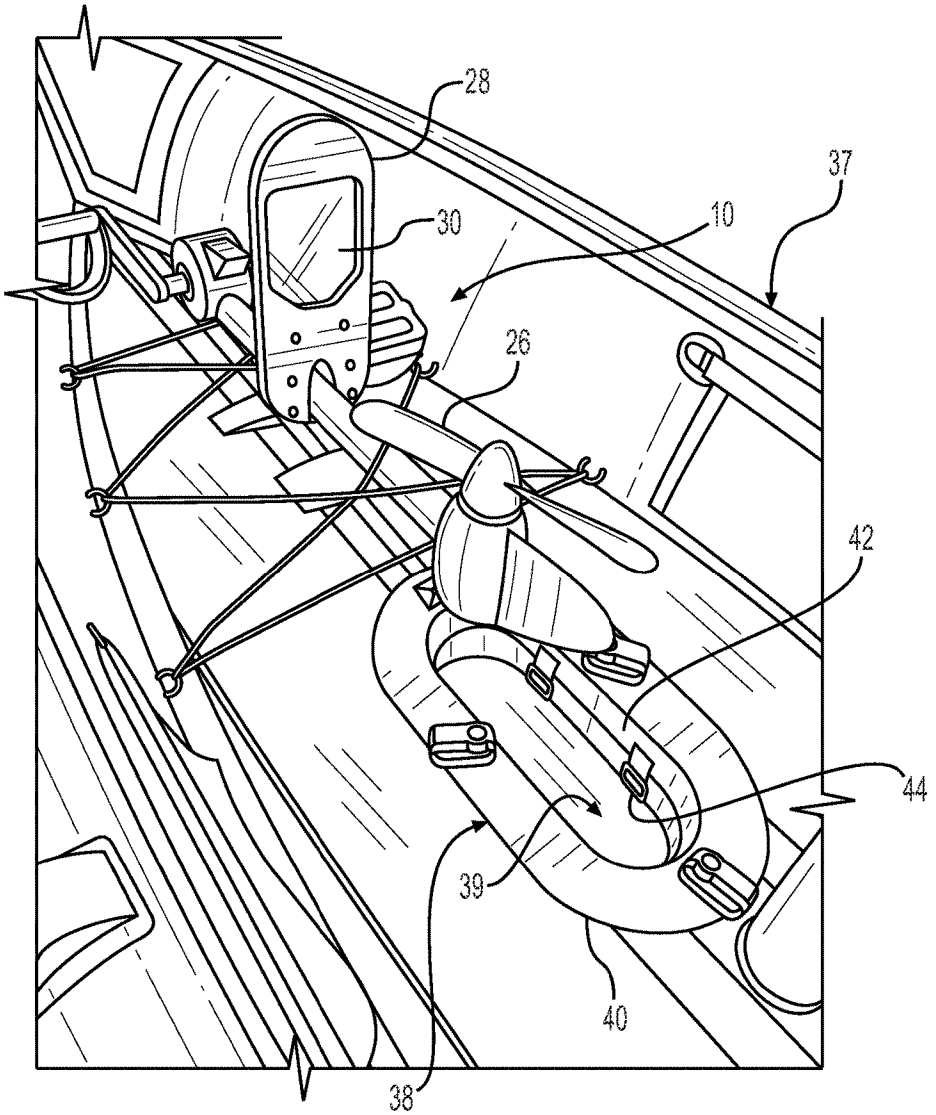
FIG. 2 is an enlarge, partial top perspective view showing the drive assembly positioned on the floor of a watercraft in an inoperable or stowed position, next to an opening provided in the watercraft into which the drive assembly is partially extended and around which the pedal assembly is detachably coupled.

Referring to FIG. 2, the pedal drive assembly 10 is shown in an inoperative or stowed position on a forward floor portion of a watercraft 37. The watercraft 37 is a kayak made of inflatable drop stitch material. As described in my co-pending and issued US patents, drop stitch inflatable watercraft other than single panel SUPs, include a number of substantially flat panels that are held together by vinyl or other plastic strips of material adhered along common edges. In the illustrated embodiment, the watercraft 37 includes opposite side panels that converge together at the fore end to form a bow, and remain essentially parallel at the aft end to form a stern. The floor panel is bonded to the two opposite side panels, thereby giving the watercraft 37 its kayak shape.

Referring to FIGS. 1 and 2, the coupling means 14 includes a base 38 having a horizontally oriented flange 40 that circumscribes an opening 39 formed in the floor of the watercraft 37. A collar 42 extends into the opening 39, and is snug fitted to the sidewall of the opening. The opening 39 does not interrupt the airtight interior of the floor panel, due to the sidewall of the opening. Thus, the opening 39 must be made while the floor panel is being made, and cannot itself be retrofitted or retro-engineered. Complimentary fastener means 44 are provided along the lower portion of the collar and on the outside surface of the floor panel. The fastener means 44 can include nylon straps adhesively bonded to the watercraft around the opening 39, and mating nylon straps adhesively bonded to the collar 42. A suitable snap fit connection can be provided by end fittings on the straps that include "G" connectors receiving complimentary and insertable end fittings for the other straps.

The base 38 may be provided with the watercraft or may be purchased as an add-on feature. Thus, if a consumer chooses not to purchase a pedal drive, the watercraft 37 may include a base 38 which can be mounted in and around the opening 39 after the watercraft 37 is inflated. Once inserted into the opening 39, the straps of the base coupling means 44 can be snap fitted to each other, and adjusted in length so that the base 38 is secured tightly to the watercraft 37 with no excess play or spacing between the base 38 and the opening 39. Other suitable coupling means 44 can be used, including snaps, ties, and other complimentary structures. Although less desirable, the base could be permanently bonded in the position illustrated in FIG. 2, with the disadvantage that folding and stowing may be complicated by having a rigid structure in an otherwise flexible, foldable product.

Figure 3:
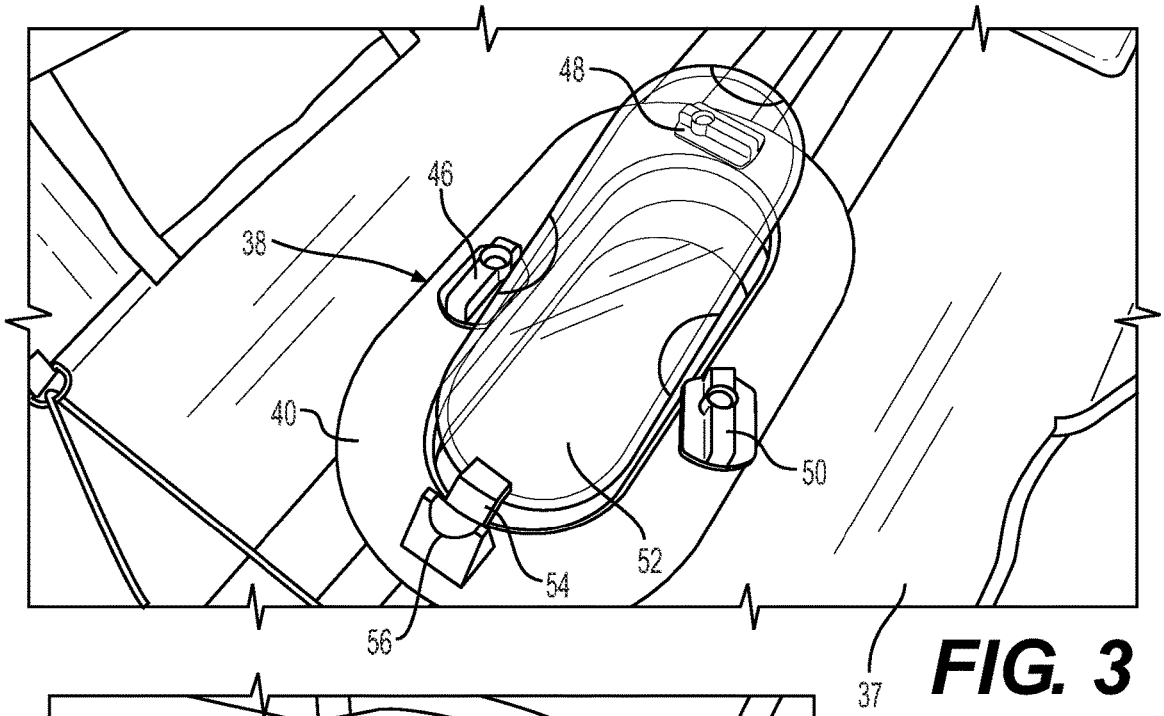
FIG. 3A is a top perspective view of an opening or pedal port formed in the watercraft.
FIG. 3B is a top perspective view similar to FIG. 3A but showing a clear window fitted over the opening.

As seen in FIG. 3, the base 38 includes rotatable dogs 46, 48 and 50 located at equidistantly spaced intervals around the flange 40. A clear plastic window 52 is sized and dimensioned to fit into an opening 39 formed in the watercraft 37. The window 52 has an integrally formed foot 54 provided at one end. The foot 54 slides into a receptacle 56 formed on the forward end of the flange 40 when the window 52 is being installed in the opening while the window 52 is at a slight angle to the flange 40. Once the foot 54 and receptacle 56 are engaged, they form an open hinge which can be used to rotate the window 52 downwardly over the opening and into engagement with the flange 40. Once in the installed position, dogs 46, 48 and 50 are rotated so that they engage side surfaces of the window 52 at portions that are arcuately shaped indentations.

The aforementioned foot and receptacle pivot connection can be replaced by simply by having a plate with no foot, and forming a block and extension, and sliding the edge of the plate under the extension. This arrangement would be similar in appearance to the foot and receptacle, but is somewhat simpler in construction and just as effective. From the illustrations, the foot and receptacle could simply be a block and extension, with a part of the window fitted under the extension.

When the pedal drive means is not used with the watercraft 37, the base 38 and window 52 are used to close the opening in the watercraft. As a clear window, the user can view what is under the watercraft 37 through the window.

Figure 4:
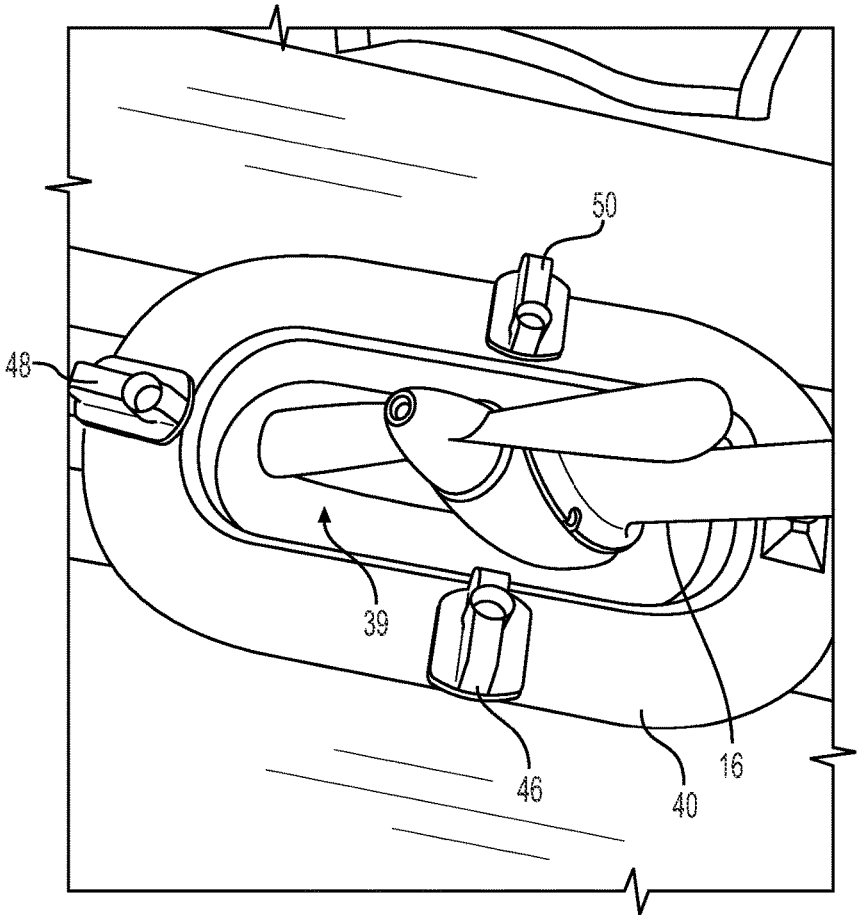
FIG. 4 is a top perspective view of the opening in the watercraft, with the window removed, and the pedal drive assembly being moved into the opening.

Referring to FIGS. 3 and 4, when installing the pedal drive assembly, a user at first will remove the window 52 by turning the dogs 46, 48 and 50 to release them from the window 52. The foot 54 is then pulled away from the receptacle 56, freeing the window completely and thus exposing. Alternatively, the foot 54 could be an extension of the receptacle 56, in which case the edge of the window 52 is simply slid free. Once the window is removed, and as seen in FIG. 4, the lower end of the drive shaft 16 is inserted into the opening 39.

Figure 6:
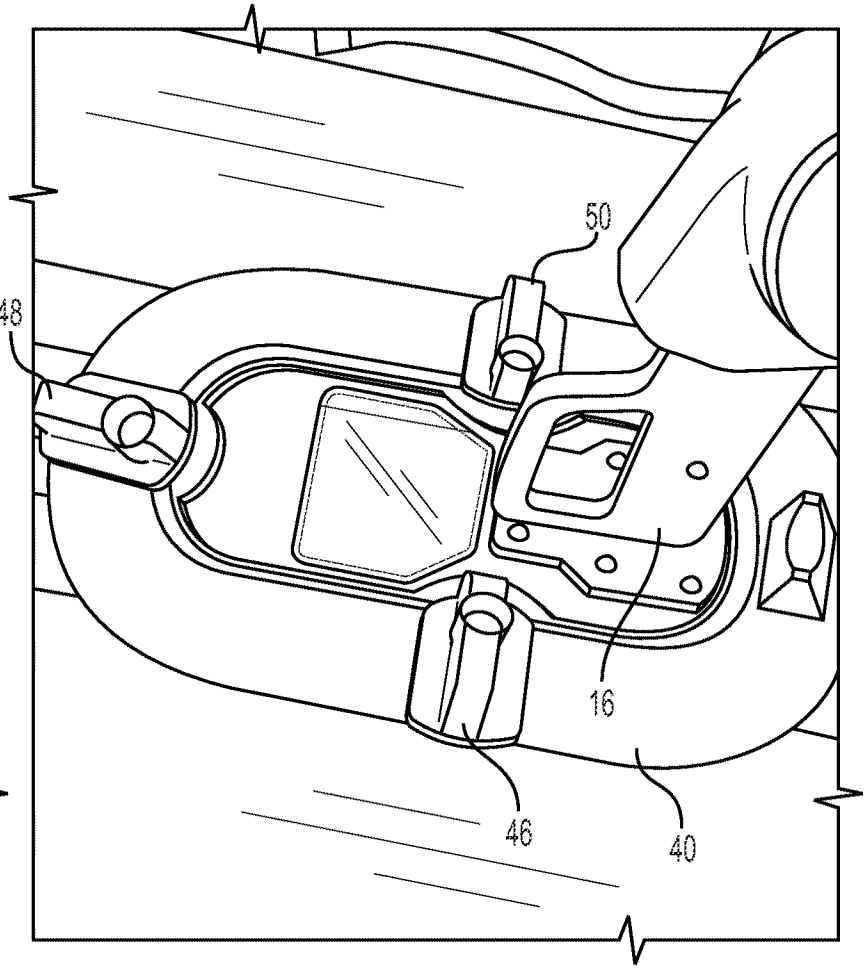
FIG. 6 is a top perspective view of the opening in the watercraft, with the mounting plate fully seated over the opening in the watercraft.
Figure 5:
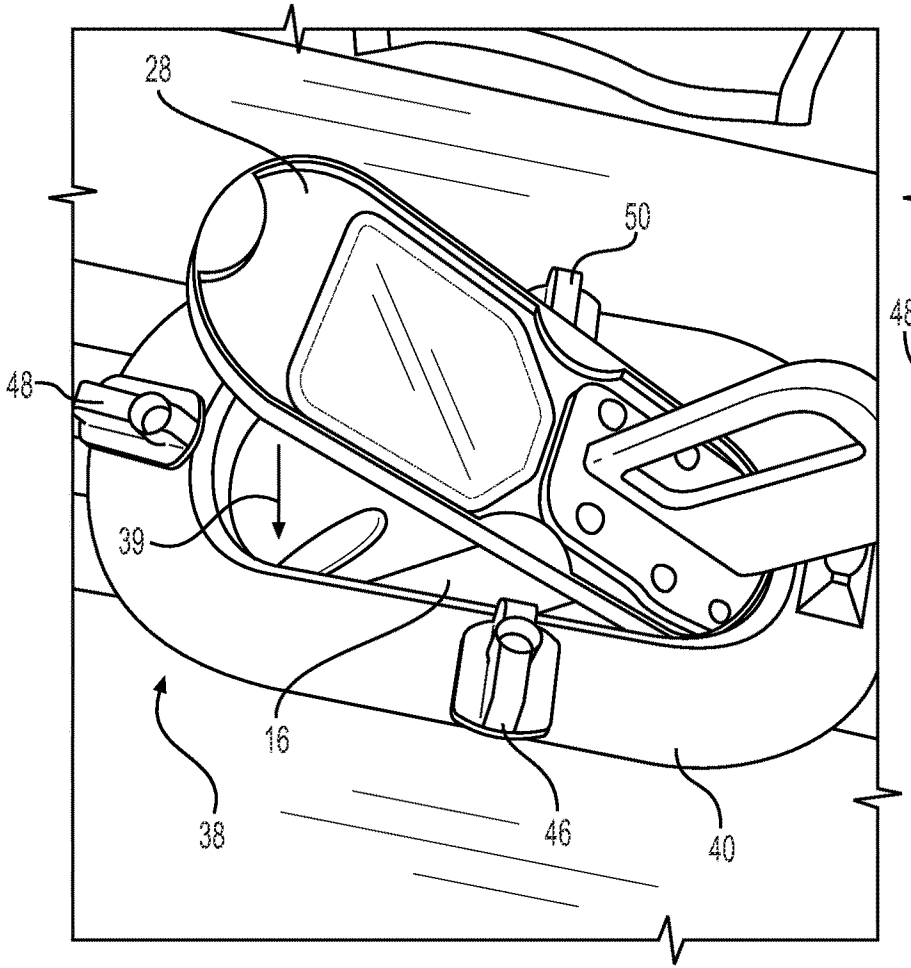
FIG. 5 is a top perspective view of the opening in the watercraft, with the pedal drive shaft rotated into position, with the mounting plate nearing its seated position over the opening.

As seen in FIGS. 5 and 6, the pedal drive assembly is shown sequentially moving into the engaged position, wherein the drive shaft 16 is in a vertical position when fully installed, the mounting plate 28 is seated over the opening 39 and attached to the base 38 by rotating the dogs 46, 48 and 50 into engagement with the periphery of the mounting plate 28. With the pedal drive assembly in place, the user pedals the device at a desired speed. If the watercraft approaches shallow water or solid objects, the user can turn the dogs to a release position, and the entire assembly can be tilted forward to raise the propeller upwards. This avoids damaging the propeller and drive shaft. In this operation, the pedal drive assembly rotates about the mounting pin 34. Alternatively, the pin 34 can be removed, and the assembly lifted vertically upwardly.

Figure 7:
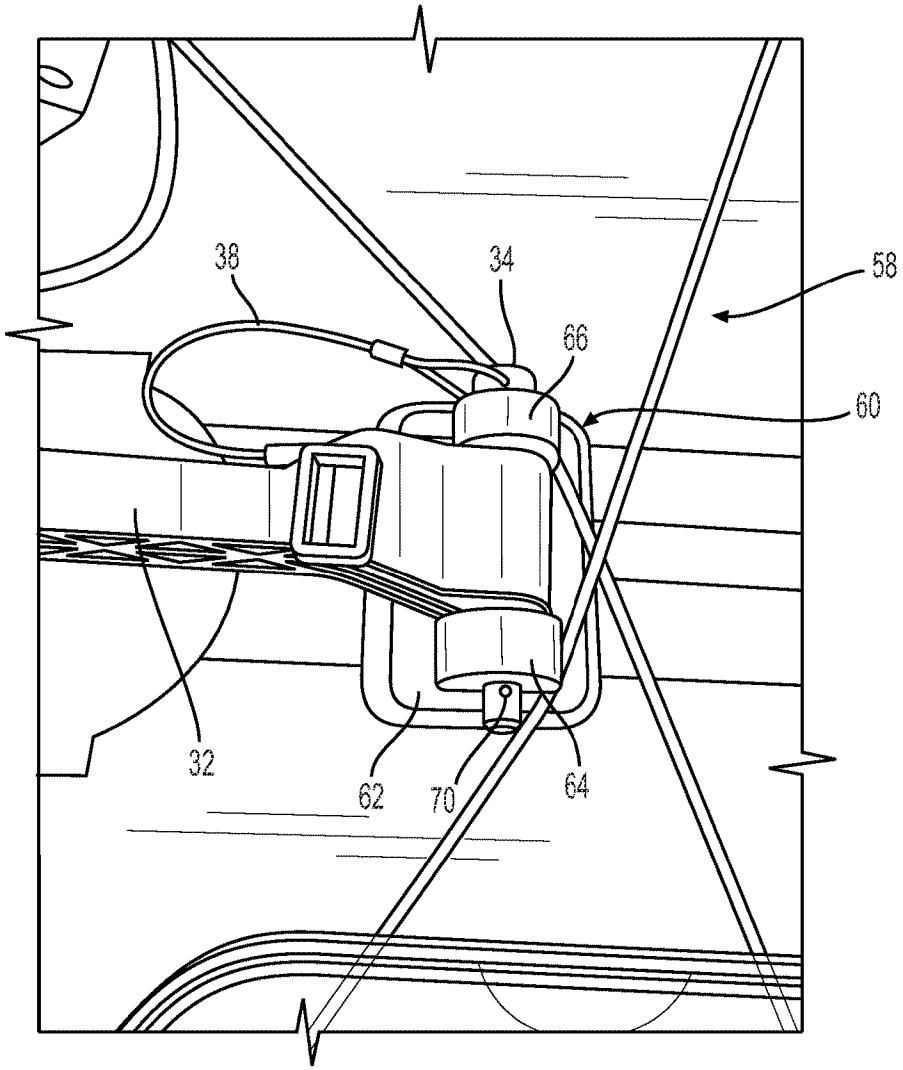
FIG. 7 is a top perspective view of a pivotal joint between a mounting arm and the watercraft.

As seen in FIG. 7, the mounting arm 32 has a lower end portion having a transverse axial bore which receives the mounting pin 34. In operation, to connect the mounting arm 32 to a floor 58 of the watercraft, a bracket 60 is permanently affixed to the floor 58 forward of the opening 39. The bracket 60 includes a flat base pad 62 made of hard, strong plastic material, which is adhered to the floor using suitable adhesive or other bonding means. The bracket includes parallel arms 64 and 66 each having a bore aligned with each other. When attaching the mounting arm 32, the pin 34 is removed from the mounting arm 32, the bores of the arms 64 and 66 are aligned with the bore provided in the mounting arm 32, and once aligned, the mounting pin 34 is inserted into the aligned bores. The pin 34 includes a strap 68 connecting the pin 34 to the mounting arm 32 to avoid loss. The end of the pin 34 includes a ball detent 70 which resists incidental movement of the pin 34 out of position, but allows for a moderate pulling force to overcome the detent 70 to permit removal of the pin. The detent 70 is of a well-known type where the ball is spring biased outwardly.

When an inflatable watercraft such as a kayak is fitted with the pedal drive assembly, it is preferable to provide a separate hand-actuated steering system. When the kayak is paddled with a paddle, steering is effected with the paddle. While a paddle could be used to steer while a user peddles the peddle drive assembly, an added feature of the present invention is to provide a hand operated tiller which can be operate with little effort and virtually no body movement except at the hand.

Figure 8:
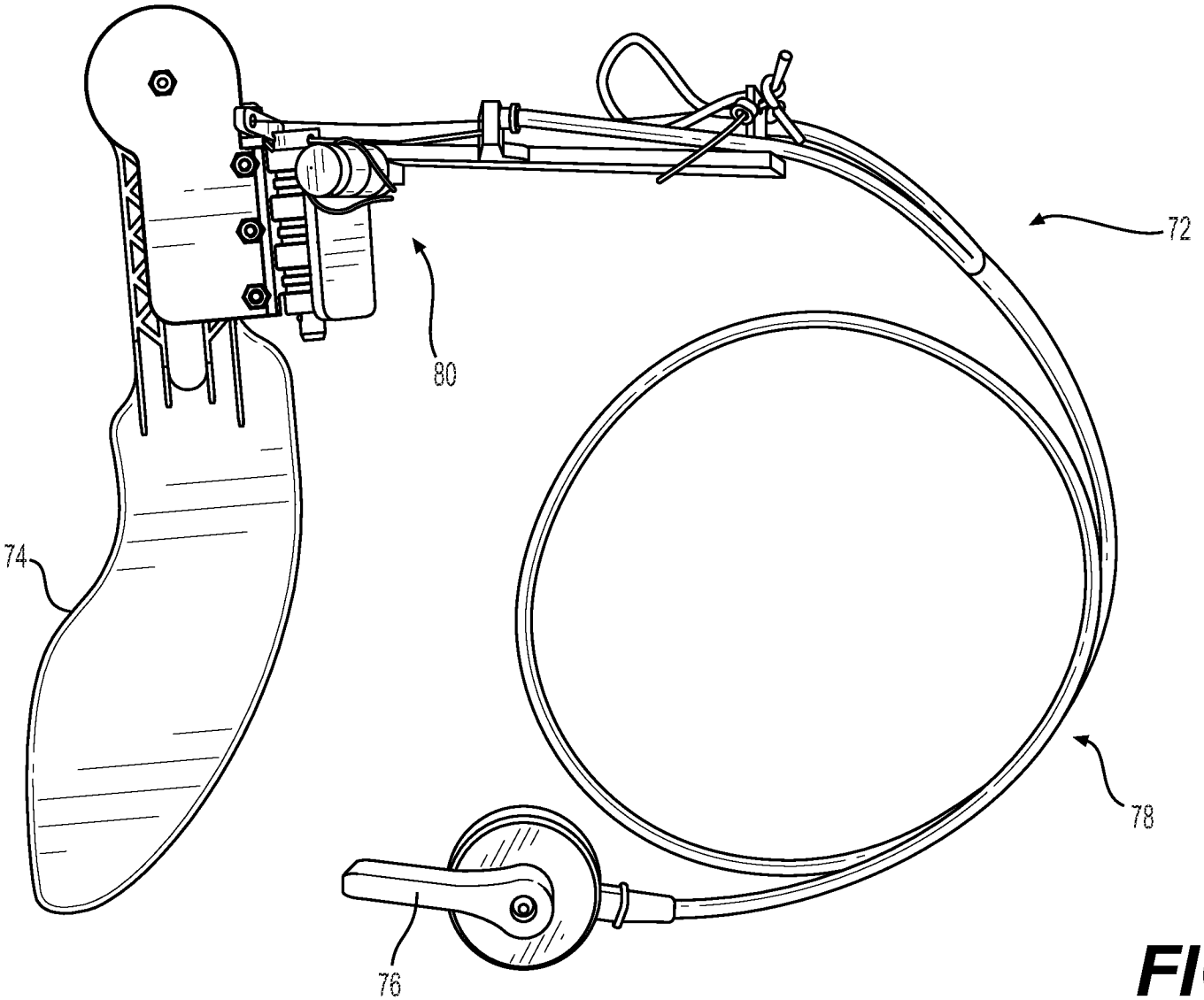
FIG. 8 is a side view of a steering rudder assembly connectable to a watercraft when the watercraft is fitted with a pedal drive assembly.

As seen in FIG. 8, a steering assembly 72 is shown as a complete kit that can be retrofitted onto an inflatable, drop stitch watercraft made from multiple inflatable panels of drop stitch material. The assembly 72 includes a rudder 74, a hand operated tiller 76, and push pull cables connecting the rudder 74 to the tiller 76. A mounting means 80 includes mounting pins that permit the rudder to move port to starboard, about a vertical axis, as well as permitting the rudder to move vertically downwardly to an operate position in the water and vertically upwardly out of the water or away from obstructions or shallow water.

Figure 9:
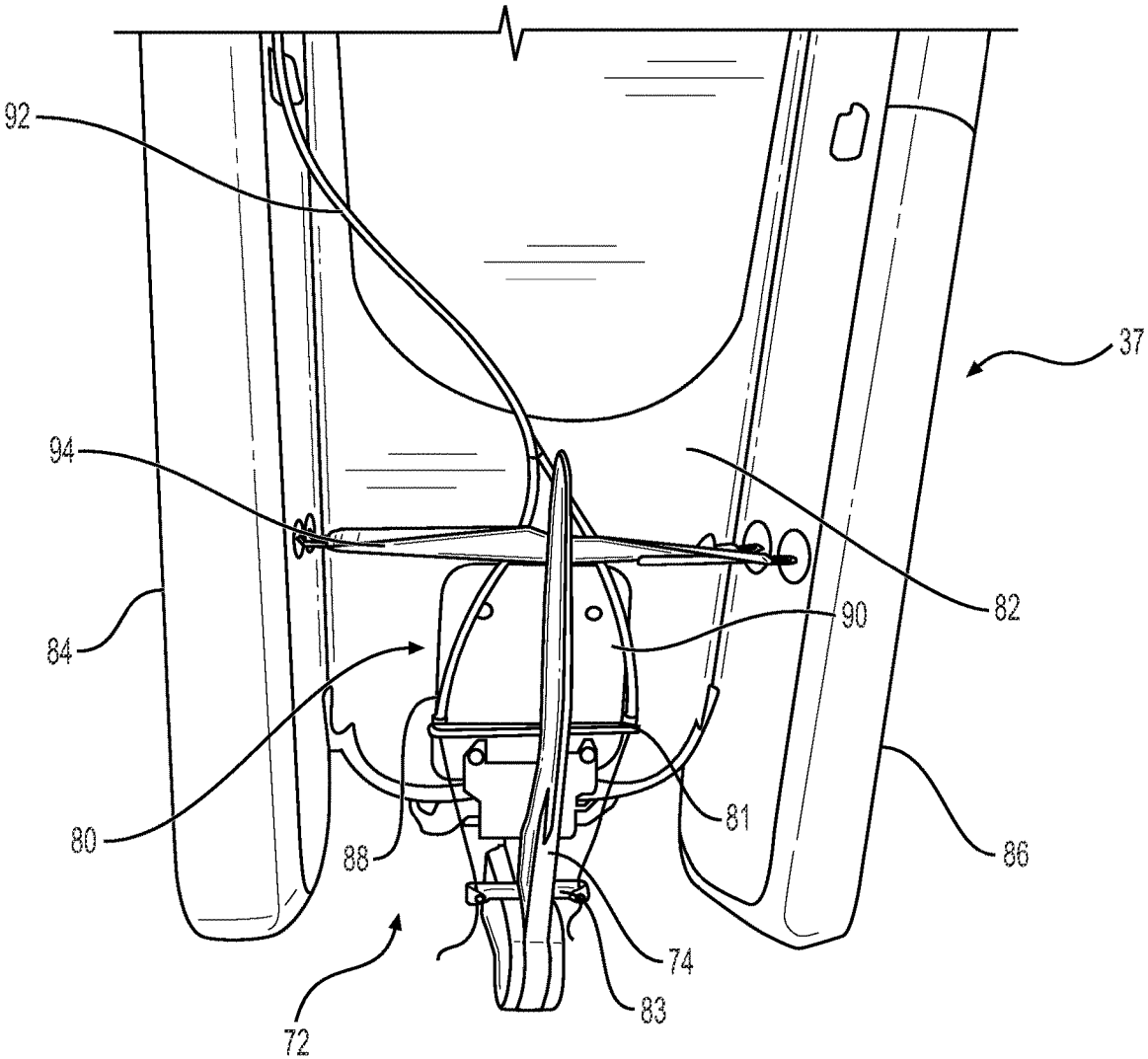
FIG. 9 is a top view of a stern portion of an inflatable drop stitch watercraft according the present invention, and showing mounting means for mounting the rudder to the watercraft.

Details of how the rudder is attached to the watercraft are shown in FIG. 9. First, it is understood that the watercraft 37 is made of three separate drop stitch inflatable panels, including a bottom panel 82, a port side panel 84 and a starboard side panel 86. The panels are bonded to each other through vinyl strips that overlay on abutting edges of the panels. The side panels extend vertically upwardly from the horizontal bottom panel. Preferably, the bottom panel does not extent the full length of the side panels, so that the mounting structures are not exposed, and in fact, are protected by the side panels and the deck panel (not shown in FIG. 9) which detachably connects to the top edges of the side panels.

The steering assembly 72 includes mounting means 80 detachably connected to the stern of the watercraft. The mounting means 80 includes a hard plastic rectangular plate 88 which is permanently adhered to the bottom panel 82 on the upper surface thereof, which serves as the floor of the watercraft 37. A removable plate 90 is connected to the permanently mounted plate 88 by any suitable means, including screw fasteners. The removable plate 90 includes a horizontal pin and a vertical pin to allow the rudder 74 to move about a vertical axis to the port and starboard directions, and about a horizontal axis to move the rudder out of the water. In FIG. 9, the rudder 74 is pivoted fully out of the engaged position and is resting over the mounting means 80. A push pull cable operates so that left and right turns of the tiller 76 cause the rudder to move left and right by pulling on opposite sides of a t-bar. Ends of the push pull cable sheathing terminate at the non-movable t-bar 81. The wire cable extending from the ends of the sheathing connect to a movable, smaller t-bar 83.

The left and right cables, separately sheathed, are wrapped together or otherwise placed in a common sheath to avoid clutter and provide a better appearance. The combined cable 92 can run to the port side or starboard side, depending on which side the user prefers to operate the tiller. In FIG. 9, the cable 92 runs along the port side.

As further seen in FIG. 9, a nylon strap 94 is interleaved between a plurality of b-rings that are bonded to the inner surfaces of the side panels 84 and 86. The strap 94 assists in holding the side panels 84 and 86 firmly in an upright position, as well as providing a resting place for the rudder when it is folded into the watercraft 37.

Figure 10:
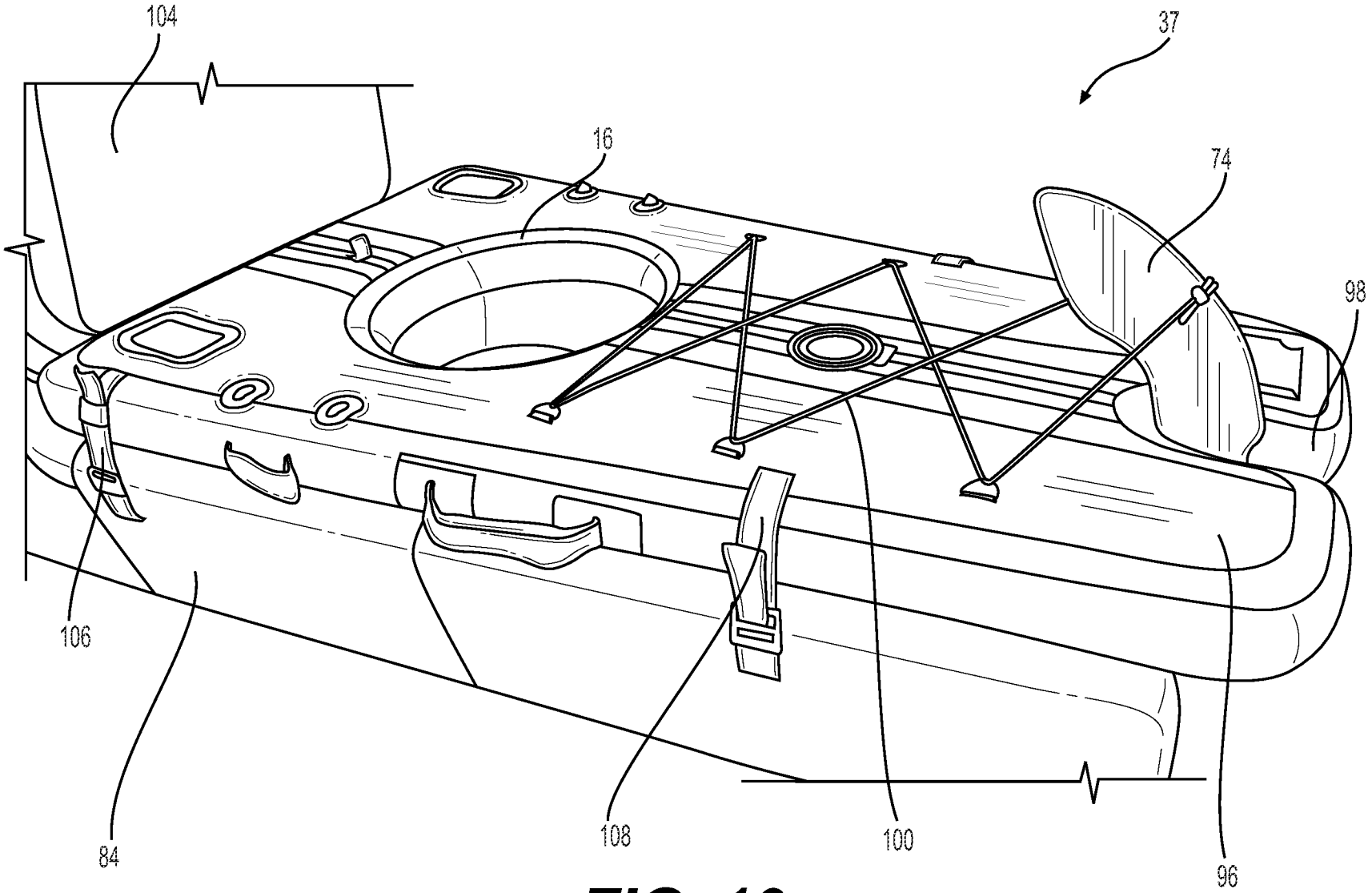
FIG. 10 is a top perspective view of a rear portion of a watercraft according to the present invention, and showing the deck panel, rudder in a stowed position, and passenger seat.

As seen in FIG. 10, the watercraft 37 includes a removable deck panel 96 which is also made of inflatable drop stitch material. The rear portion of the deck panel 96 includes a channel 98 into which the rudder 74 is pivotally received when the watercraft is out of the water, or if in the water the user prefers to paddle with a conventional kayak or canoe paddle. Bungee cording 100 is preferably provided on the removable deck panel 96 to hold objects and to hold the rudder 74 in a stowed position as shown. The deck panel 96 further includes a circular opening 102 which can hold, for example, a circular cooler having a closed top, or a circular bucket for holding any objects that the user desires. Cabling for the steering mechanism is below the deck panel and thus out of site and protected by the deck panel 96.

Forward of the deck panel 96, an inflatable drop stitch seat 104 has a back portion and a seat portion, both of which are attached to the floor or bottom panel 82 with nylon straps. The seat 104 is the subject of my separate, co-pending patent application which is hereby incorporated by reference. The deck panel 96 is attached to the tops of the side panels 84 and 86 with at least four Velcro straps of which straps 106, 108 are visible in FIG. 10. This allows for easy access and removal of the deck panel 96 should the user need to adjust the steering mechanism.

Figure 11:
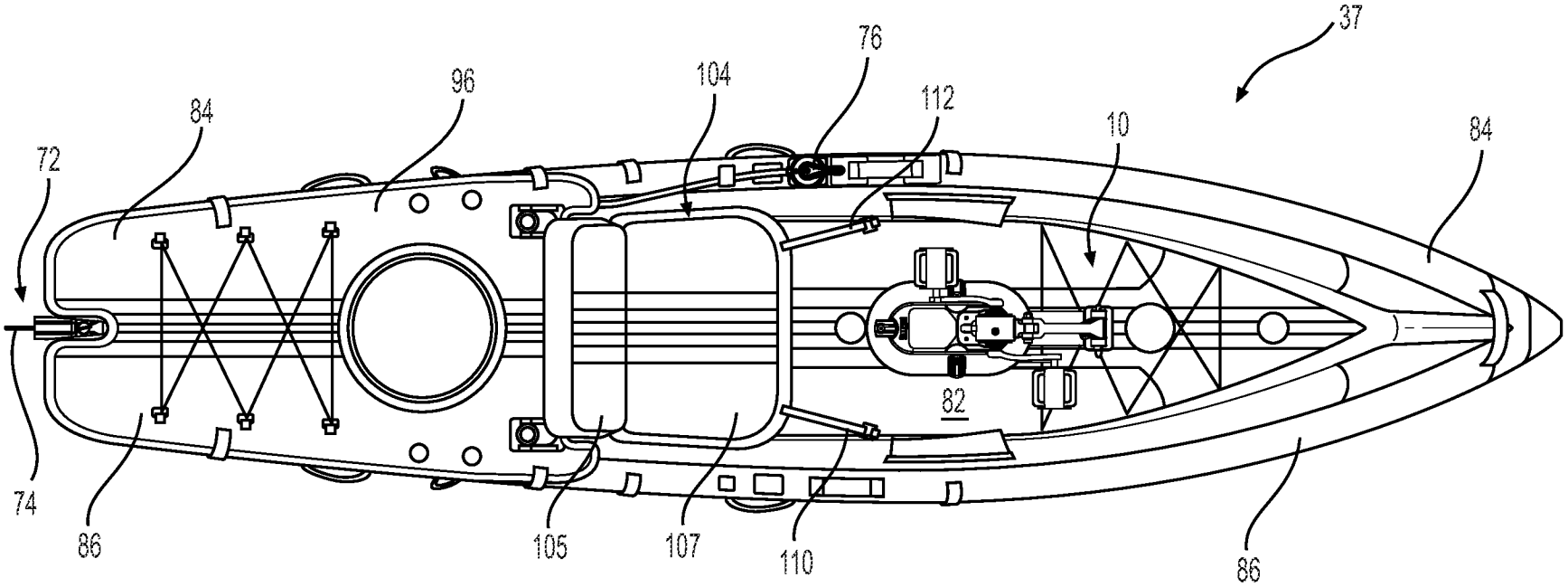
FIG. 11 is a top view of a watercraft according to the present invention, combined with a steering assembly and pedal drive assembly.
Figure 12:
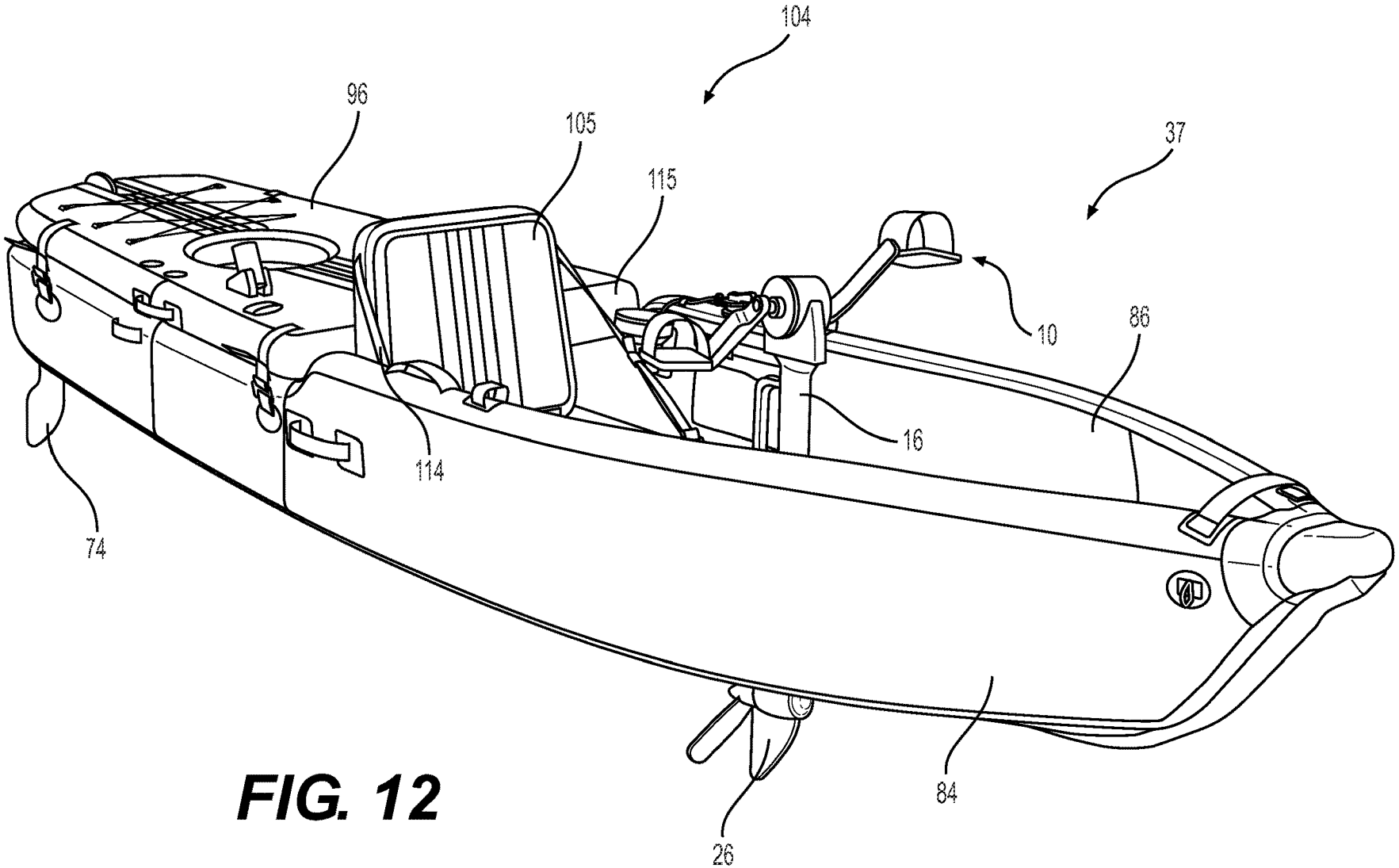
FIG. 12 is a side perspective view of the watercraft of FIG. 11.
Figure 13:
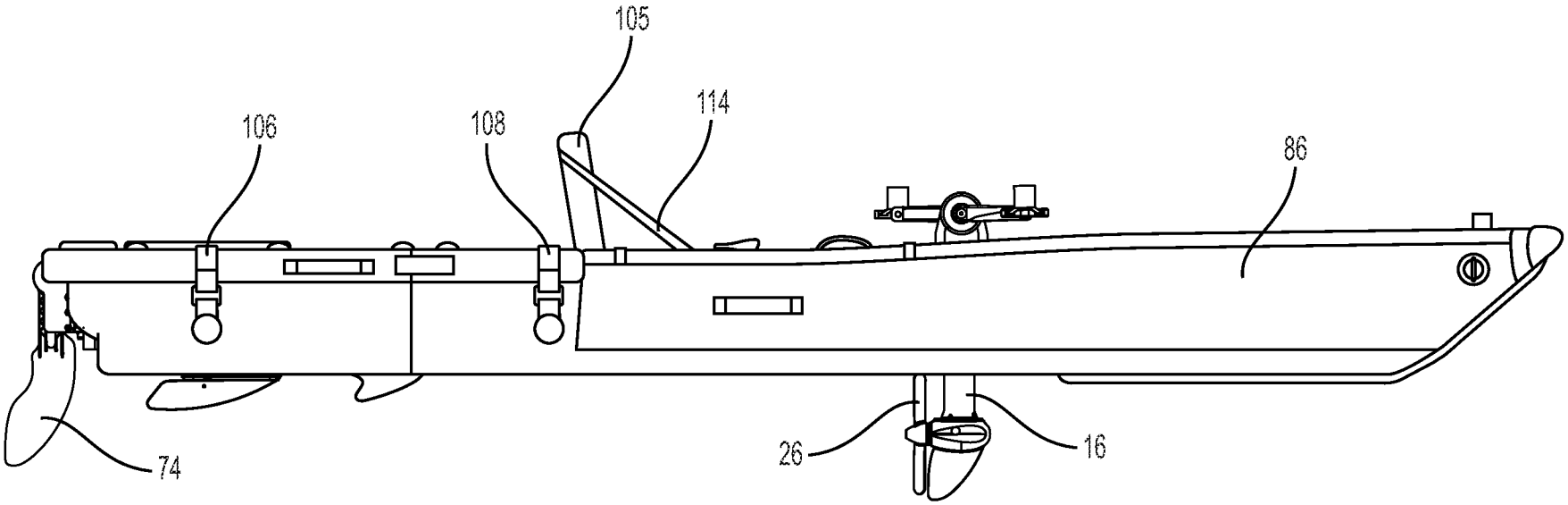
FIG. 13 is a side view of the watercraft of FIG. 11.

Referring to FIGS. 11-13, the combination of pedal drive, steering mechanism and inflatable drop stitch material watercraft is shown as a kayak. The watercraft 37 includes a port side panel 84, a starboard side panel 86 and a bottom panel 82. Each panel is separately inflated through inflation valves to high pressures, in the general range of 4 p.s.i. to 20 p.s.i., and once inflated, the panels adopt the physical characteristics of a solid structural material such as wood, metal, fiberglass or molded plastic. A seat 104 is also made of inflatable drop stitch material, and includes a back panel 105 and a seat panel 107. The seat 104 uses a plurality of adjustable nylon straps 110, 112, 114, to anchor the seat 104 in a desired position, selected based on the height of the user, so that the user's legs have the proper distance to the pedals of the pedal drive.

The pedal drive assembly 10 is shown attached to the watercraft 37, whereby the drive shaft 16 is partially below the watercraft and thus the waterline when on water, and partially above the waterline, extending upwardly from the floor of the watercraft 37. Similarly, the steering assembly 72 includes a rudder 74 that extends below the waterline and partially above. The tiller 76 is mounted on the port side of the watercraft 37.

Figure 14:
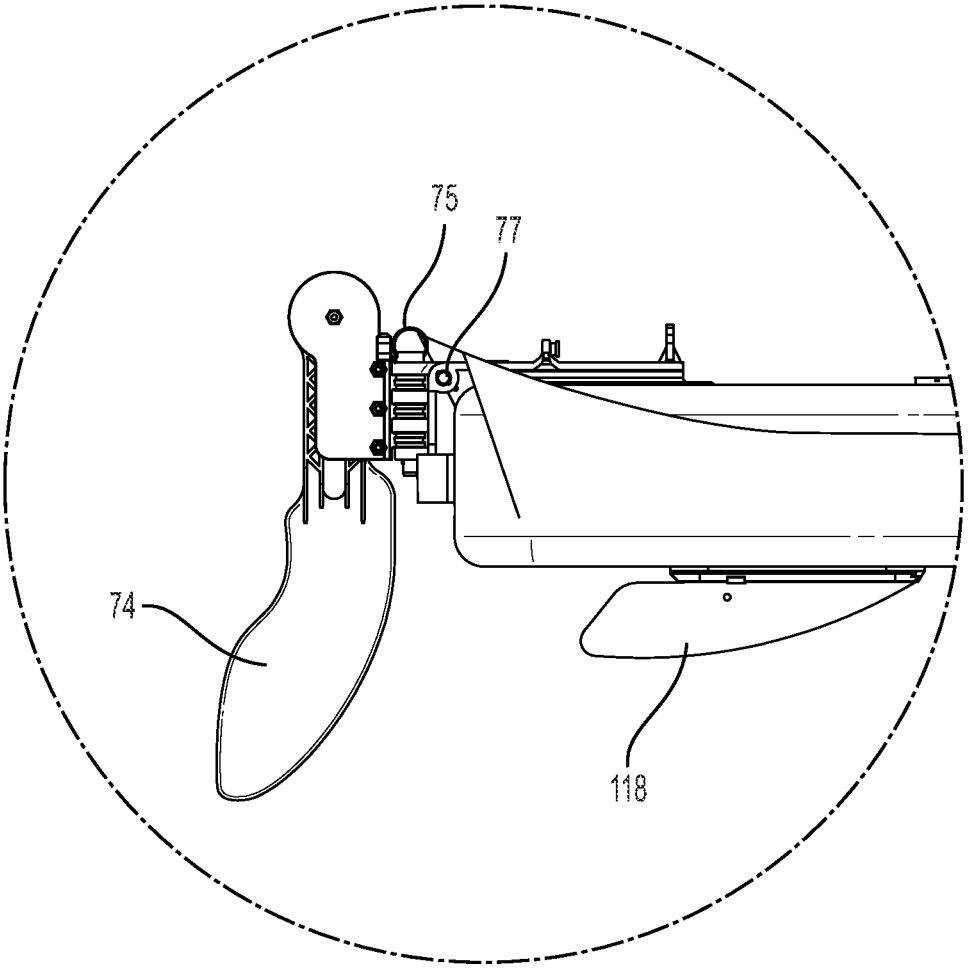
FIG. 14 is an enlarged side view of rudder mount according to the present invention.

As seen in FIG. 14, the rudder 74 is capable of moving left to right by rotating about vertical pin 75, when the push pull cables are actuated by the tiller 76. A second, horizontal pin 77 allows for rotation about a horizontal axis to allow the rudder 74 to pivot upwardly for stowage, or to avoid damage from shallow water or obstacles.

Figure 16:
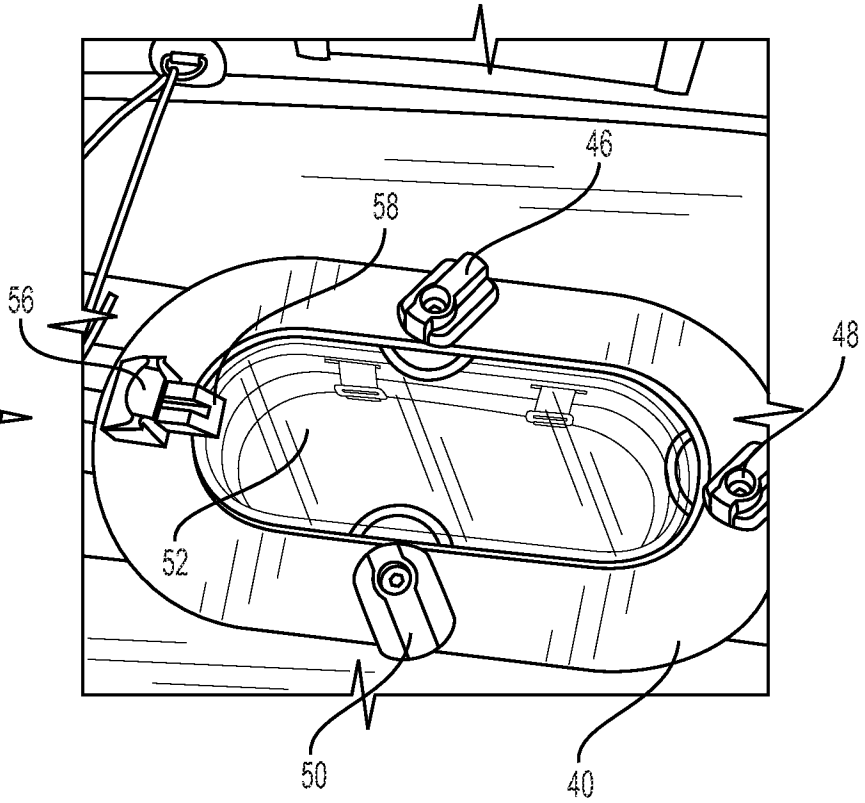
FIGS. 15 and 16 are enlarged views of the opening provided in the watercraft and the base that fits into the opening, for mounting the pedal drive assembly.
Figure 15:
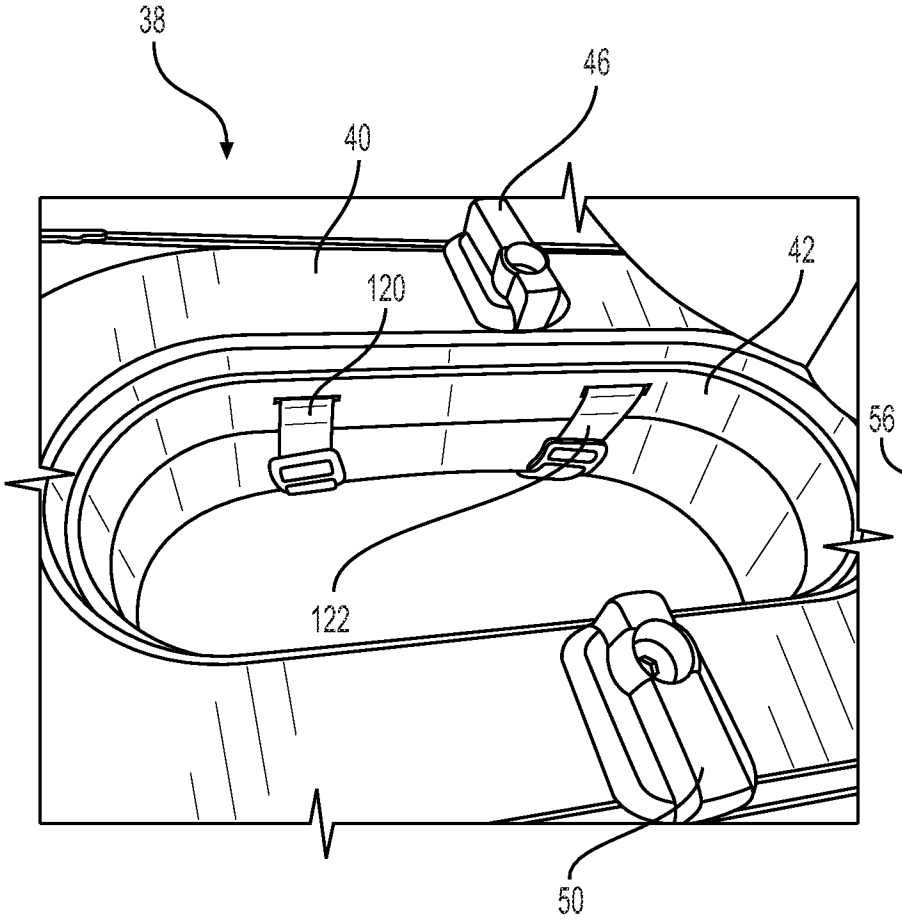

FIGS. 15 and 16 illustrate with greater clarity how the base 38 is mounted in the opening of the watercraft. Straps 120 and 122 have portions mounted respectively to the collar 42 of the base 38, and to the bottom panel of the watercraft. Preferably the strap portions have complimentary couplings, such as a G connector that snap fits with a corresponding structure to allow quick connect and disconnect.

Figure 17:
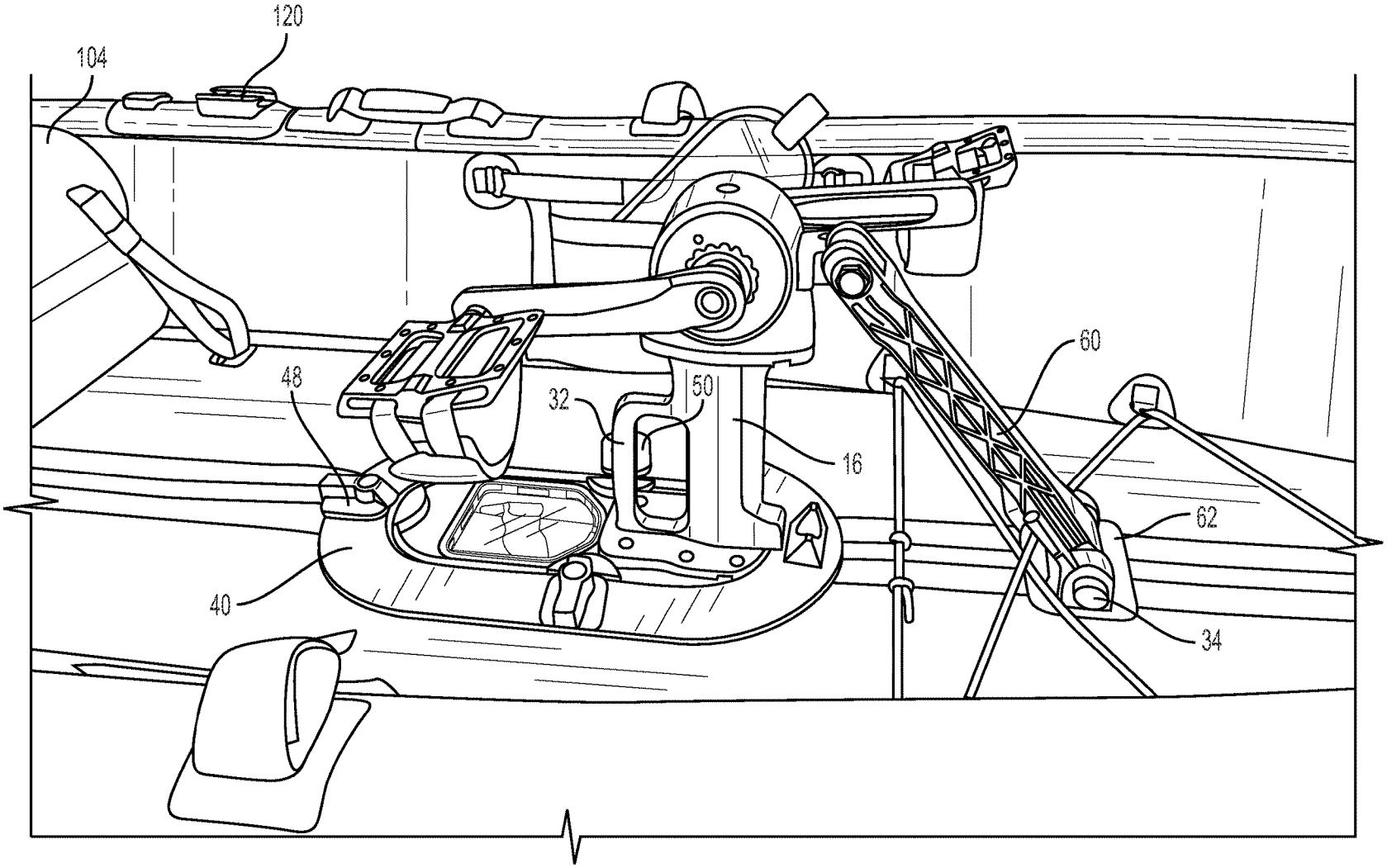
FIG. 17 is a side perspective view showing the pedal drive assembly mounted to the floor of the watercraft.

As seen in FIG. 17, the mounting plate 28 is shown firmly held in the opening by dogs 46, 48 and 50, which can be quickly released to allow the entire pedal drive assembly to be lifted from the opening and laid longitudinally on the floor of the boat. In certain fishing situations, it may be desirable to pedal to a desired fishing hole, and then lay the pedal drive assembly on the floor so that the user can move more freely to cast in different directions. FIG. 17 also illustrates the importance of the mounting arm 32 which opposes longitudinal forces generated by the user when peddling. The mounting arm 32 thus provides multiple uses, one being to secure the assembly to the floor when peddling is not required, and the other is to brace the pedal assembly to prevent excessive wear on the mounting plate 28 and base 38, and thus the dogs 36, 48 and 50.

One feature of the watercraft of the present invention is that the user can add accessories to fit the needs of the user. In order to prevent making it difficult to fold the deflated watercraft, it is important that all accessories are easily removed and installed, as for instance, are the pedal drive assembly and the steering assembly. Referring to FIG. 14, a skeg 118 is shown on the bottom of the watercraft. The skeg 118 is an add-on that can be installed after inflation by sliding the skeg 118 into a groove or track bonded to the underside of the bottom panel. The mounting groove or track is slender, flexible and thus will not prevent folding during storage of the deflated watercraft. Similarly, referring to FIG. 17, the track 120 is provided for mounting the tiller 76. The track 120 can be made of flexible plastic material so that it likewise does not bind or otherwise prevent folding of the deflated watercraft. Other accessories can be similarly installed, such as fishing pole mounts drink holders, etc.

Although specific embodiments of the present invention have been described, it will be understood by those of skill in the art that there are other embodiments that are equivalent to the described embodiments. Accordingly, it is to be understood that the invention is not to be limited by the specific illustrated embodiments, but only by the scope of the appended claims.

What is claimed is:

1. A drive assembly for an inflatable watercraft having an opening extending through a bottom of the inflatable watercraft, comprising:

a drive shaft comprising a first axial end and a second axial end opposite the first axial end, and an axle extending through the drive shaft from the first axial end to the second axial end;

first and second pedal support arms, wherein the first and second pedal support arms are rotatably and coaxially interconnected to the first axial end of the drive shaft and to the axle;

first and second pedals, wherein each of the first and second pedals is rotatably mounted to the first and second pedal support arms;

a propeller rotatably interconnected to the second axial end of the drive shaft and to the axle, wherein rotation of the first and second pedal support arms imparts rotation to the axle and to the propeller;

a base comprising a collar adapted to extend into the opening and a flange adapted to extend circumferentially around an upper perimeter of the opening; and a mounting plate interconnected to a medial portion of the drive shaft and extending substantially perpendicular to the drive shaft, wherein the mounting plate is adapted to sealingly engage the base portion.

2. The drive assembly of claim 1 further comprising a mounting arm having a first end rotatably interconnected to the first axial end of the drive shaft, and a second end adapted to be detachably connected to a bottom interior surface of the inflatable watercraft.

3. The drive assembly of claim 2 wherein the second end of the mounting arm is adapted to rotate about the detachable connection.

4. The drive assembly of claim 1 wherein the base further comprises a plurality of rotatable dogs for securing the mounting plate to the base.

5. The drive assembly of claim 3 wherein the drive assembly is adapted to rotate from a first storage position having a substantially horizontal orientation to a second operating position having a substantially vertical orientation.

6. The drive assembly of claim 5 wherein in the first storage position the drive shaft does not extend through the base, and in the second operating position the drive shaft extends through the base.

7. The drive assembly of claim 1 wherein the mounting plate further comprises a window.

* * * * *